US007188924B2

(12) United States Patent
Chen et al.

(10) Patent No.: US 7,188,924 B2
(45) Date of Patent: Mar. 13, 2007

(54) CIRCUIT AND METHOD FOR ESTIMATING PULSE FREQUENCY OF NOZZLE IN INK-JET HEAD

(75) Inventors: Jessen Chen, Hsinchu (TW); Yu-Chu Huang, Hsinchu (TW); Jane Chang, Hsinchu (TW); Hsiang-Pei Ou, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 341 days.

(21) Appl. No.: 10/868,794

(22) Filed: Jun. 17, 2004

(65) Prior Publication Data

US 2005/0134619 A1 Jun. 23, 2005

(30) Foreign Application Priority Data

Dec. 23, 2003 (TW) ..... 92136625 A

(51) Int. Cl.
*B41J 29/393* (2006.01)
*B41J 29/38* (2006.01)
*B41J 2/05* (2006.01)

(52) U.S. Cl. ..... 347/19; 347/5; 347/14; 347/60

(58) Field of Classification Search ..... 347/19
See application file for complete search history.

(56) References Cited

U.S. PATENT DOCUMENTS

| | | | | |
|---|---|---|---|---|
| 4,791,435 | A | 12/1988 | Smith et al. | |
| 5,168,284 | A | 12/1992 | Yeung | |
| 6,517,175 | B2 * | 2/2003 | Kanaya et al. | 347/19 |
| 2004/0070637 | A1 * | 4/2004 | Kanematsu et al. | 347/14 |

* cited by examiner

*Primary Examiner*—Stephen Meier
*Assistant Examiner*—Jannelle M. Lebron
(74) *Attorney, Agent, or Firm*—Birch, Stewart, Kolasch & Birch, LLP

(57) ABSTRACT

A circuit and a method of estimating pulse frequencies of nozzles in an ink-jet head use a new mechanism of estimating pulse frequencies of nozzles instead of in a conventional counting mechanism. The circuit includes a DRAM, an adder and a method control mechanism. The method control mechanism controls the access method. The DRAM retrieves a plurality of pulse frequency parameters of nozzles after ink-jet cycle signals are received. The adder adds the parameters and weighted values to update pulse frequency parameters. The updated parameters are saved back to the DRAM.

9 Claims, 2 Drawing Sheets

CIRCUIT AND METHOD FOR ESTIMATING PULSE FREQUENCY OF NOZZLE IN INK-JET HEAD

This Non-provisional application claims priority under 35 U.S.C. § 119(a) on Patent Application Ser. No(s). 092136625 filed in Taiwan on Dec. 23, 2003, the entire contents of which are hereby incorporated by reference.

BACKGROUND OF THE INVENTION

1. Field of Invention

The present invention relates to a circuit and a method of estimating a pulse frequency of nozzle in an ink-jet head, and more particularly to a circuit and a method of estimating a pulse frequency of nozzle in an ink-jet head to provide real-time pulse frequency of nozzles for the temperature control of nozzles in an ink-jet head.

2. Related Art

The printing quality of a thermal bubble ink-jet printer is closely related to the temperature control of the ink-jet head. The ink inside an ink chamber is heated into bubbles by a thermally resistive layer and then ink-jets from the nozzles. The temperature of the ink-jet head greatly influences sizes of ink drops. During the ink-jet printing, the change in the temperature of the ink-jet head causes non-uniform sizes of the ink drops, which deteriorates the printing quality. Therefore, the temperature control of the ink-jet head is very important.

A conventional method of controlling the temperature of the ink-jet head adds a thermistor as a temperature sensor to measure the change in the temperature of the ink-jet head and perform the temperature control according to the temperature change. However, the thermistor measures the temperature of the whole ink-jet head, rather than the temperature of individual nozzles. Therefore, it is hard to estimate sizes of ink drops for each nozzle, and to compensate the drop loss caused by the temperature change of the individual nozzles. This is a critical issue particularly in high-precision ink-jet applications, such as ink-jet print color filters or polymer electro-actuated illumination elements that require highly precise control of ink volume. Not only the average temperature but also the temperature change for each nozzle needs to be compensated.

In the light of manufacturing technology and cost, using a thermistor to measure each nozzle is not practical. Therefore, an approach using a percentage of each nozzle per unit time is a basis for measuring the temperature change. The higher the using frequency of the nozzle per unit time, the higher the temperature is, and vice versa. U.S. Pat. No. 4,791,435 discloses using a counter to count ink-jet pulse of each nozzle. The prior art is only applied in the time the disclosure was proposed because the number of nozzles of the conventional ink-jet head is small while the circuit of the counter is not big. However, '435 is not suitable for current ink-jet heads that have a large number of nozzles. Otherwise, the circuit for the counter must be huge.

Another approach to estimate the pulse frequency of the nozzle is disclosed in U.S. Pat. No. No. 5,168,284. Image data are dot-to-dot checked before being printed. Each pixel corresponds to a nozzle, and then all nozzles are summed up. This method has to 'dot-to-dot' check all the image data, which woks with low efficiency.

SUMMARY OF THE INVENTION

It is therefore an object of the invention to provide an estimating circuit and a method of estimating pulse frequencies of nozzles of an ink-jet head, in which a new estimating mechanism is used to replace the conventional counter, and in which the circuit has a reduced area due to the characteristics of a nozzle address space circuit, which allows the application of different amounts of ink-jet heads in an ink-jet head.

In order to achieve the above and other objectives, the estimating circuit for estimating pulse frequencies of nozzles of an ink-jet head according to the invention includes a DRAM, an adder and a process control mechanism. The DRAM is used to save a plurality of the pulse frequency parameters of nozzle. The process control mechanism is used to control and save the pulse frequency parameters of nozzles. The adder is used to retrieve one pulse frequency parameters of nozzles from the process control mechanism and adds the retrieved parameter and one weighted value to update the parameter that is then saved back to the DRAM.

Each pulse frequency parameter of nozzles has an address for an address signal of each nozzle, or for an address signal of one group of nozzles. Furthermore, a multiplexer and a plurality of weighted value registers are provided. The multiplexer retrieves one weighted value from its corresponding weighted value register according to the ink-jet pulse of the ink-jet cycle. The weighted value can be adjusted according to the characteristics of the nozzle, the width of the ink-jet pulse, the width of the pre-heated pulse, the wave shape of the ink-jet pulse and the driving voltage.

With the use of the above circuit, a method of estimating pulse frequencies of nozzles in an ink-jet can be implemented. The method includes receiving ink-ink-jet cycle signals; getting a plurality of pulse frequency parameters of nozzles from a DRAM; adding one pulse frequency parameter and a weighted value for updating the pulse frequency parameter; and saving the updated the pulse frequency parameters of the nozzle back to the DRAM.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below illustration only, and thus are not limitative of the present invention, wherein.

DETAILED DESCRIPTION OF THE INVENTION

Figure 1:
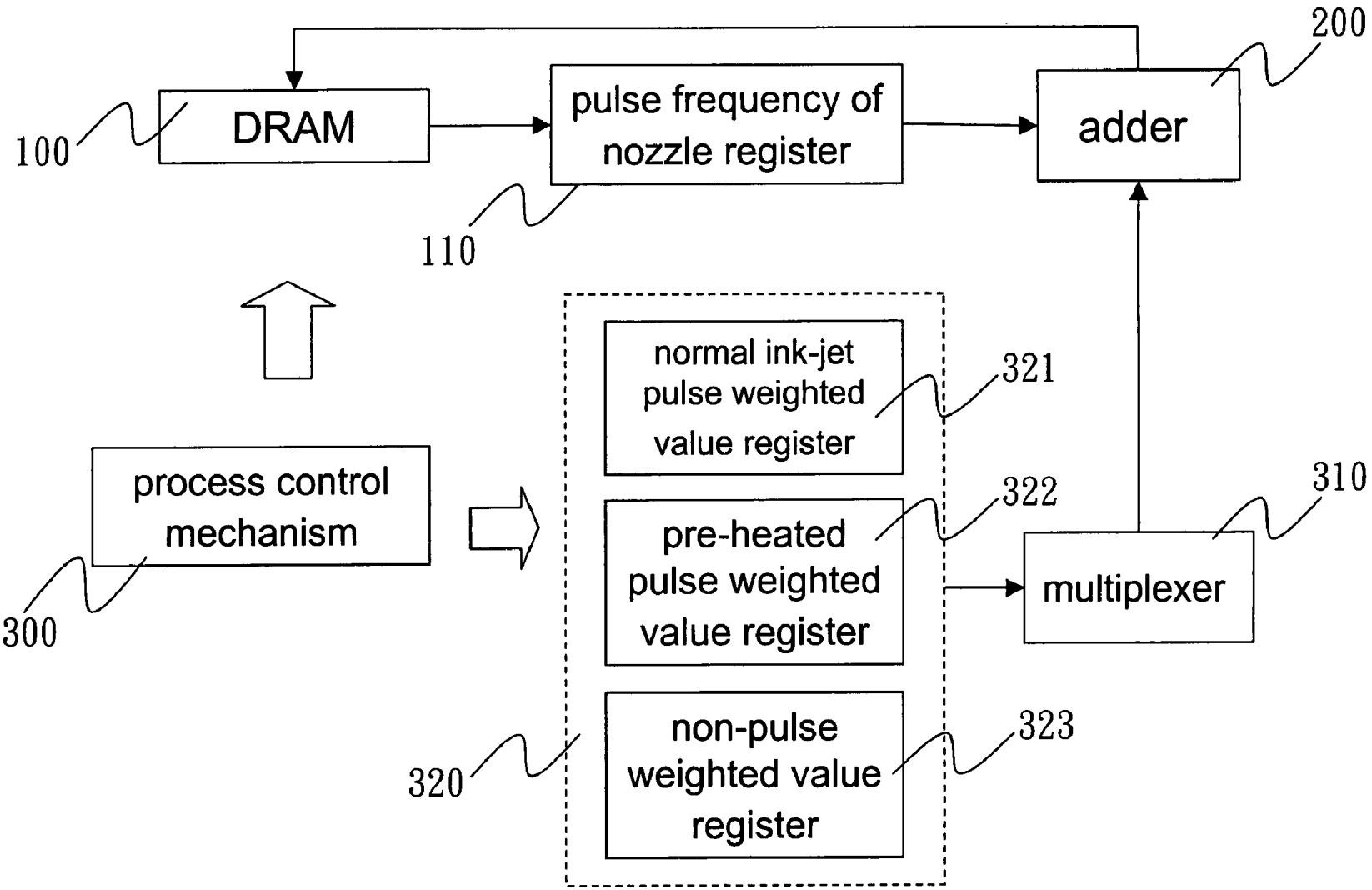
FIG. 1 is a schematic view of the operation of an estimating circuit used to estimate a pulse frequency parameters of a print head according to one embodiment of the invention.

FIG. 1 is a schematic view of the operation of an estimating circuit used to estimate a pulse frequency parameters of a print head according to one embodiment of the invention. The circuit provides a real-time pulse frequency parameters of a nozzle for the control of the nozzle temperature in the print head. The circuit includes a DRAM 100, a pulse frequency of nozzle register 110, an adder 200, a process control mechanism 300, a multiplexer 310 and a plurality of weighted value registers 320. The DRAM 100 saves a plurality of parameters regarding the pulse frequency of nozzle. Each parameter has an address for address signal of each nozzle, or for one group of nozzles. The pulse frequency of nozzle register 110 receives a plurality of pulse frequency parameters output from the DRAM 100 when the ink ink-jet cycle signal is received. The process control mechanism 300 controls and saves the pulse frequency of nozzle by using the pulse frequency of nozzle register 110 and the weighted value register 320. Three weighted value registers 320 are included in this embodiment, each having a normal ink-jet pulse weighted value register 321, a pre-heated pulse weighted value register 322 and a non-pulse weighted value register 323 for respectively saving a normal ink-jet pulse weighted value, a pre-heated pulse weighted value and a non-pulse weighted value. The multiplexer 310 picks up one of the weighted values according to the ink-jet status of each ink-jet cycle. The adder 200 retrieves one pulse frequency parameter of a nozzle from the process control mechanism 300 via the pulse frequency of nozzle register 110, and adds the retrieved pulse frequency parameters of nozzles and one weighted value provided by the multiplexer 310, to obtain an updated pulse frequency of nozzle that is then saved back to the DRAM 100.

In FIG. 1, in an initial status, the settings of the DRAM 100 turn to zero. At the beginning, the DRAM 100 receives the ink-jet cycle signals including nozzle addresses and ink-jet statuses. The multiplexer 310 gets the normal ink-jet pulse weighted value when a normal ink-jet pulse is provided. The multiplexer 310 gets the pre-heated pulse weighted value when a pre-heated pulse is provided. The multiplexer 310 gets the non-pulse weighted value when no pulse is provided (i.e. no energy is provided). The pre-heat pulse offers a small amount of energy before ink-jetting, to vibrate the ink inside the nozzle without spreading the ink around. When no pulse is provided, the temperature goes down. Therefore, the non-pulse-weighted value is negative and the relationship between those values is as follows: the normal ink-jet pulse weighted value>the pre-heated pulse weighted value>0>the non-pulse weighted value.

Figure 2:
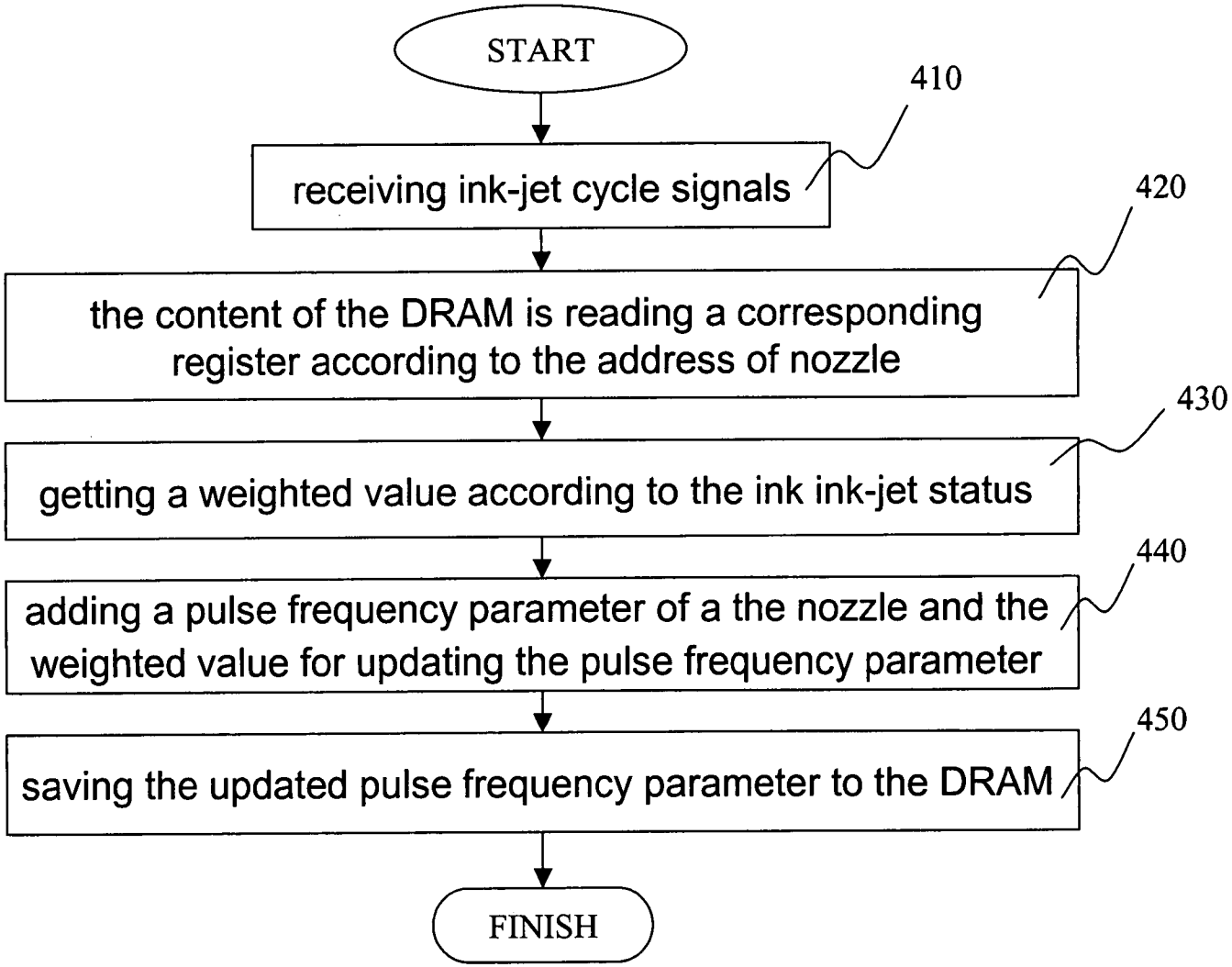
FIG. 2 is a flowchart of a method of estimating a pulse frequency of the nozzle in the ink-jet head according to one embodiment of the invention.

FIG. 2 is a flowchart of a method of estimating a pulse frequency of the nozzle in the ink-jet head according to one embodiment of the invention. The method includes receiving ink-jet cycle signals (including nozzle addresses and ink-jet statuses) (step 410) when the ink-jet operation begins; the content of the DRAM is reading a corresponding register according to the address of nozzle (step 420); getting a weighted value according to the ink ink-jet status (step 430); adding a pulse frequency parameter of a the nozzle and the weighted value for updating the pulse frequency parameter (step 440); and saving the updated pulse frequency parameter to the DRAM (step 450). At step 430, the multiplexer 310 gets the normal ink-pulse weighted value when a normal ink-jet pulse is provided, gets a pre-heated pulse weighted value when a pre-heated pulse is provided, or gets a non-pulse weighted value when no pulse is provided.

Knowing the invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An estimating circuit for estimating a pulse frequency of a nozzle in an ink-jet head, the circuit comprising:

a DRAM, used to save a plurality of the pulse frequency parameters of the nozzles;

a process control mechanism, used to control and save the pulse frequency parameters of the nozzles;

an adder, used to retrieve one pulse frequency parameter of the nozzle from the process control mechanism and add the retrieved parameter and one weighted value to update the parameter that is then saved back to the DRAM; and a multiplexer and a plurality of weighted value registers. wherein the weighted value registers save different weighted values, and the multiplexer sends one corresponding weighted value to the adder via a corresponding weighted value register.

2. The circuit of claim 1, wherein the pulse frequency parameter has an address for address signal of the nozzle.

3. The circuit of claim 1, wherein the pulse frequency parameter has an address for address signal of one group of the nozzles.

4. The circuit of claim 1, wherein the registers includes a normal ink-jet pulse weighted value register, a pre-heated pulse weighted value register and a non-pulse weighted value register for respectively saving a normal ink-jet pulse weighted value, a pre-heated pulse weighted value and a non-pulse weighted value.

5. The circuit of claim 4, wherein the normal ink-jet pulse weighted value>the pre-heated pulse weighted value>0>the non-pulse weighted value.

6. A method of estimating a pulse frequency of a nozzle in an ink-jet head, the method comprising:

receiving ink-jet cycle signals each including a nozzle address and ink-jet status;

getting a plurality of pulse frequency parameters of the nozzles from a DRAM;

getting a weighted value according to the ink jet status, including getting one normal ink-jet pulse weighted value when a normal ink-jet pulse is provided. getting pre-heated pulse weighted value when a pre-heated pulse is provided, or getting non-pulse weighted value when no pulse is provided;

adding the one pulse frequency parameter and the weighted value for updating the pulse frequency parameter; and saving the updated pulse frequency to the DRAM.

7. The method of claim 6, wherein each nozzle using parameter has an address for address signal of the nozzle.

8. The method of claim 6, wherein the pulse frequency parameter has an address for address signal of one group of the nozzles.

9. The method of claim 6, wherein the normal ink-jet pulse weighted value> the pre-heated pulse weighted value>0>the non-pulse weighted value.

* * * * *